US006552626B2

(12) United States Patent
Sharpe et al.

(10) Patent No.: US 6,552,626 B2
(45) **Date of Patent: *Apr. 22, 2003**

(54) HIGH POWER PIN DIODE SWITCH

(75) Inventors: Thomas M. Sharpe, Fountain Valley, CA (US); Donald A. Charlton, Huntington Beach, CA (US); Richard W. Burns, Orange, CA (US)

(73) Assignee: Raytheon Company, Lexington, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/482,175

(22) Filed: Jan. 12, 2000

(65) Prior Publication Data

US 2002/0118076 A1 Aug. 29, 2002

(51) Int. Cl.[7] ..... H01P 1/15
(52) U.S. Cl. ..... 333/104; 455/78; 455/83
(58) Field of Search ..... 333/103, 104; 455/78, 83

(56) References Cited

U.S. PATENT DOCUMENTS 5,109,205 A * 4/1992 Hart et al. ..... 333/104
5,193,218 A * 3/1993 Shimo ..... 455/83 X
5,486,797 A * 1/1996 Suzuki ..... 333/104
5,594,394 A * 1/1997 Sasaki et al. ..... 333/104 X

FOREIGN PATENT DOCUMENTS

JP 46-5883 * 2/1971 ..... 333/104

* cited by examiner

*Primary Examiner*—Justin P. Bettendorf
(74) *Attorney, Agent, or Firm*—Leonard A. Alkov; Glenn H. Lenzen, Jr.

(57) ABSTRACT

A high power PIN diode single pole double throw (SPDT) switch for use in radar systems transmitting at over 50 watts of power. These systems require a switch that will provide adequate isolation for the sensitive amplifier circuits in the receiver subsystem of the radar from the high power transmit pulses in the event there is a bias failure such that the PIN diodes are at zero bias. By utilizing one single pole single throw (SPST) switch assembly between the transmitter and the antenna and at least two SPST switch assemblies between the antenna and the receiver, this isolation is achieved.

8 Claims, 2 Drawing Sheets

HIGH POWER PIN DIODE SWITCH

BACKGROUND OF THE INVENTION

1. Field of the Invention

This invention relates to microwave switches. More particularly, this invention relates to high power microwave switches employing PIN diodes utilized in a single pole double throw (SPDT) configuration.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

2. Description of the Related Art

For many years, switches have been used in the electrical arts to provide a means for isolating a portion of an electrical circuit. In its simplest form, a single pole/single throw (SPST) switch resides in one of two positions. In a "closed" position, the switch allows a signal to pass from an input port to an output port. In an "open" position, the switch prevents a signal from passing from the input port to the output port. A theoretically perfect switch has no series resistance or shunt admittance in the "closed" position and has either infinite series resistance, infinite shunt admittance, or both in the "open" position. A single pole/double throw (SPDT) switch selects between two separate output ports.

The earliest switches used in microwave applications were mechanical switches, but they suffered from many limitations. In response to these limitations, solid state switches were developed. These solid state switches use semiconductor devices in a variety of different configurations to provide the "open" and "closed" positions, and many employ PIN diodes as their controllable elements. PIN diodes, as is well known, are diodes that are formed from a silicon wafer containing nearly equal P type and N type impurities on opposing sides of the wafers. In the middle of the wafer there exists a barrier layer of silicon with little or no doping known as the intrinsic layer. The intrinsic layer has a relatively long recovery time that causes PIN diodes to be relatively slow in comparison to regular diodes. Higher frequency applied signals, such as those in the radio and microwave frequencies, do not cause the PIN diodes to become rectifying and forward biased during the positive portion of the signal cycle. In their unbiased or reverse biased states, the PIN diodes have a series resistance that is typically in excess of 1000 ohms and a small junction capacitance. In their forward biased state, the PIN diodes have a series resistance of approximately one to two ohms. Because of their switching and electrical characteristics, PIN diodes function well in high frequency solid state switch applications.

In one general configuration PIN diodes with their anodes connected to a transmission line segment that spans from the switch input to the switch output are employed. The cathodes of the PIN diodes are connected to ground. In the "closed" position, the PIN diodes are unbiased or reverse biased, presenting a high impedance between the transmission line segment and ground. This allows the signals to pass from the switch input to the switch output. In the "open" position, the PIN diodes are forward biased, presenting a very low impedance to the RF signals and creating both a reflection to the signal and a shunt to ground. In this position the signals do not reach the output of the switch.

In solid state antenna arrays, the low noise amplifier (LNA) on the receiver side must be protected from the high power transmit pulse to the antenna. This protection is typically provided by a limiter and circulator which in combination give about 30 dB of protection. For semi-active arrays (such as those in the Firefinder Block II radar) the transmit pulse can be very high, as much as 250 watts or more, at the subarray level. For such applications, at least about 47 dB of isolation is required. This additional protection can be provided by a SPDT PIN diode switch. This switch must be able to handle this high power level and must also be able to protect the low noise amplifier in the event a bias failure takes away the ability of the system to reverse bias the PIN diodes. The switch isolation is much higher when the PIN diodes are reverse biased than when they are in their OFF state, but unbiased.

The relevant art contains a number of references that disclose SPDT switches that use PIN diodes. U.S. Pat. No. 4,267,538 to Assal, et al. teaches a multiport PIN diode switch, but it is concerned with achieving optimal impedance matching between its various input and output ports and not with high power switching problems. U.S. Pat. No. 5,142,256 to Kane teaches another type of PIN diode switch, this one utilizing multiple PIN diodes spaced along a transmission line segment. The emphasis here is to select a particular one of the multiple PIN diodes to vary the apparent transmission line length. Again, there is no treatment of the problems of high power switching. U.S. Pat. No. 5,440,283 to Nendza discloses another PIN diode switch, this one being concerned with avoiding the use of DC blocking capacitors and quarter wavelength transmission line segments and using lumped circuit elements instead to decrease the attenuation and increase the bandwidth of the switch. Finally, U.S. Pat. No. 5,109,205 to Hart et al. describes yet another type of PIN diode switch that seeks to avoid the apparent disadvantages of using a common DC and RF ground plane with the attendant need to use blocking capacitors by providing a separate DC ground connection.

Thus, although the patents discussed above provide for significant improvements in the art, there remains an ongoing need for further improvements in the design of high power microwave switches, particularly in the provision of a practical and effective bias failure mode for very high power applications involving semi-active radar arrays with transmit power above 50 watts.

SUMMARY OF THE INVENTION

The need in the prior art for an improved high power SPDT switch is addressed by the present invention which provides at least two SPST PIN diode switch assemblies connected in series to provide for adequate isolation of the more sensitive receiver side of the radar transceiver and one SPST diode switch assembly on the transmit side of the transceiver, these two sides of the SPDT switch being oppositely biased at any one time. In the event of a bias failure the residual isolation provided by the at least two SPST assemblies is sufficient to protect the receiver section of the radar system from the high power pulses from the transmitter.

The SPST assembly either passes or blocks the transmission of an RF signal from one side of the assembly to the other. The assembly has a central node to which is connected an input transmission line and an output transmission line. Also connected to the central node are an inductive resonator and an open circuit resonating stub. The PIN diode is connected between the other side of the inductive resonator and ground. The PIN diode is also connected to a biasing means that supplies a small forward bias (about +1 volt) or a large negative bias (between about −20 to about −100 volts). This DC bias voltage is isolated from the rest of the radar system by blocking capacitors on the transmission lines leading to and from the SPST assembly. One of the SPST assemblies is used on the transmit side of the radar system and two or more of the SPST assemblies are used on the receive side. A bias controller circuit switches the bias to the single SPST assembly back and forth between forward and reverse on the transmit side of the radar while switching the bias in the opposite sense to the two or more SPST assemblies on the receive side. The operating characteristics of the SPDT switch are described in more detail below.

DESCRIPTION OF THE INVENTION

Figure 1:
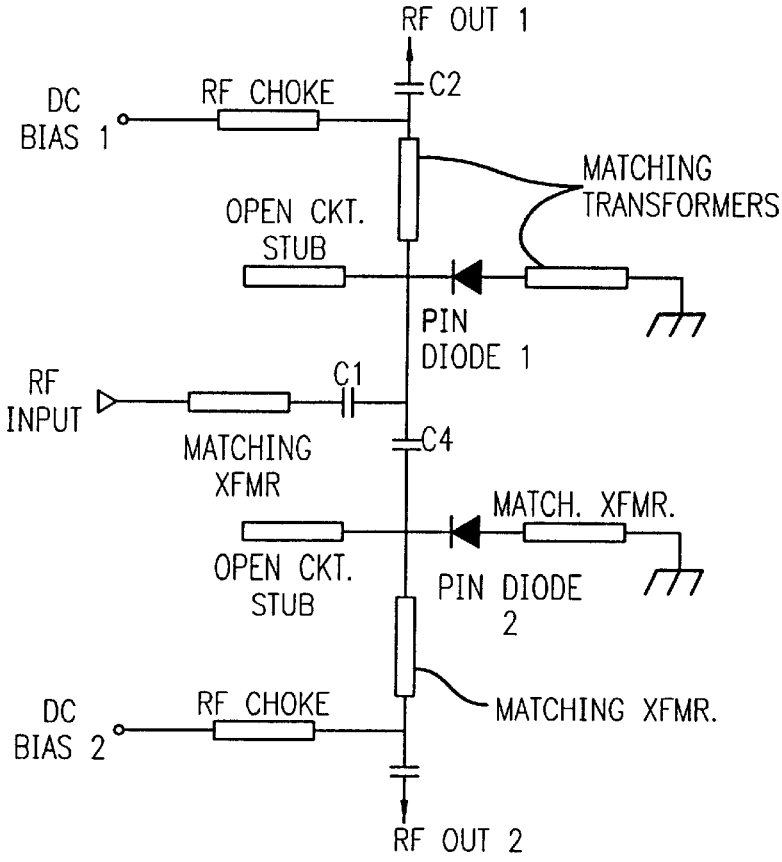
FIG. 1 PRIOR ART
FIG. 1 is a schematic diagram of a prior art PIN diode switch.

Illustrative embodiments and exemplary applications are described below with reference to the accompanying drawings to disclose the advantageous teachings of the present invention. Referring now to the drawings wherein the reference numerals designate like elements throughout, FIG. 1 shows the prior art SPDT PIN diode switch described in U.S. Pat. No. 5,109,205 mentioned above. This is a millimeter wave shunt-mounted switch designed to couple an RF input to one or the other of a pair of outputs, where first and second bias supplies are used to control the on/off state of the PIN diodes. When a diode is forward biased, it presents a low loss to RF energy but, when reverse biased, affords a high impedance. Thus, for example, if the DC biases #1 and #2 are such that the PIN diode 1 is forward biased, while PIN diode 2 is reverse biased, the RF output will appear at output #2 because output #1 is effectively held at RF ground potential. On the other hand, if the bias is such that diode 2 is forward biased and diode 1 is reverse biased, then the RF input will be switched to output #1. Here four blocking capacitors C 1–4 are required to block the DC bias current from flowing back into the input source and the output loads, and for preventing the DC bias from source 1 from reaching PIN diode 2 or vice versa. This reference does not, however, contemplate the situation where a bias failure occurs. Hence, the single PIN SPST switches on either side are not intended to provide and will not provide enough isolation to protect a sensitive device at output 1 from a high power signal intended for output 2.

Figure 2:
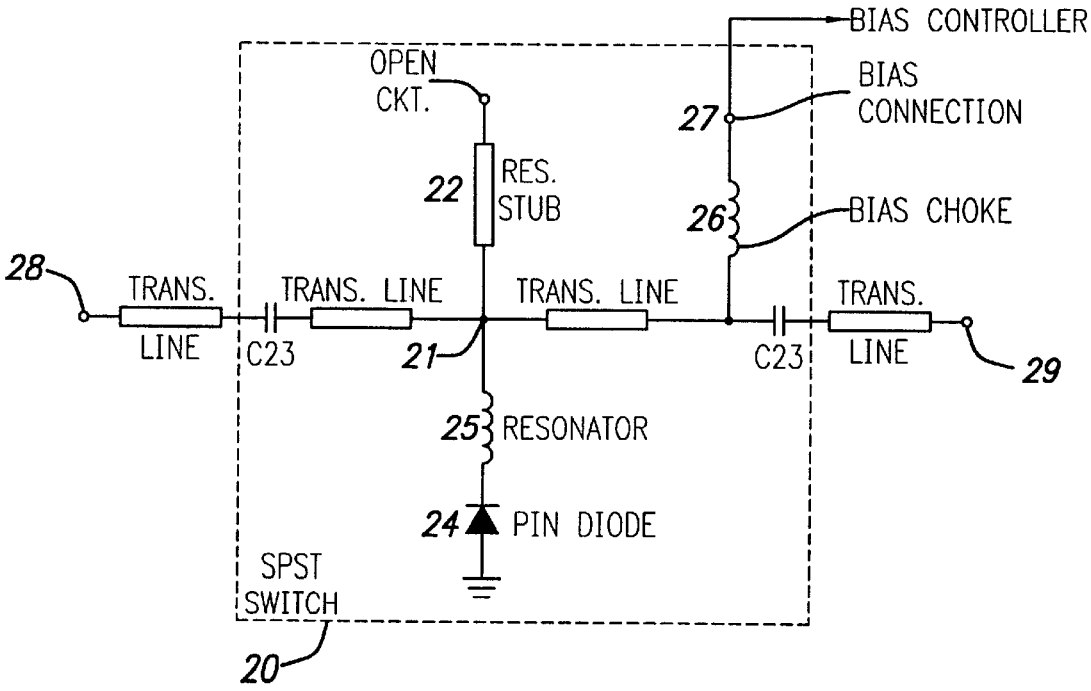
FIG. 2 is a schematic diagram of a single SPST switch assembly forming part of this invention.

The present invention is based upon the SPST switch 20 shown in FIG. 2 in which the bias on the PIN diode 24 will determine whether an RF signal entering input 28 will be passed through the switch to exit at output 29. The signal enters via node 28 through a first transmission line segment through first blocking capacitor C23 into a second transmission line segment. At the other end of this transmission line segment is central node 21 to which is connected third transmission line segment across from the second segment. The other end of the third transmission line segment is connected to a bias choke 26 and a second blocking capacitor C23 which is in turn connected to a fourth transmission line segment which is connected to node 29. Also present at the central node 21 are connections to an open circuit resonant stub 22 and the inductive resonator 25 which is connected at its other end to the PIN diode 24 whose other side is connected to ground. The bias for the PIN diode comes from a bias connection 27 which is connected to the end of the bias choke 26 opposite to the transmission line segments. A quarter wavelength transmission line segment could be substituted for the bias choke 26. These two equivalent elements are described as RF isolation means in the appended claims. The bias connection 27 is also connected to a bias controller, not shown, that coordinates the bias of the various PIN diodes in the larger SPDT switch of this invention. The circuit that makes up the bias controller is not shown but is within the capability of one of ordinary skill of the art to design. In the specific system embodiment contemplated here, an S-band radar transmitting and receiving at 3.1 to 3.4 GHz, there is a need to switch the SPST assemblies between about a positive 50–80 volts and a negative 20–100 milliamps, preferably about a negative 80 milliamps.

Figure 3:
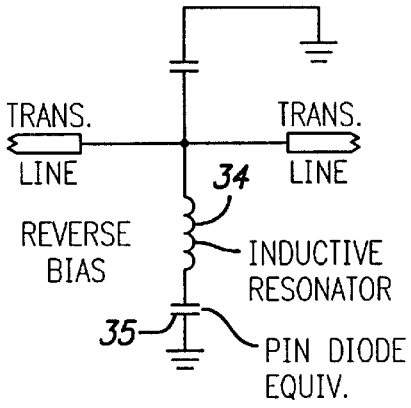
FIG. 3 is a schematic diagram of a circuit model for the SPST assembly in a reverse bias condition.
Figure 4:
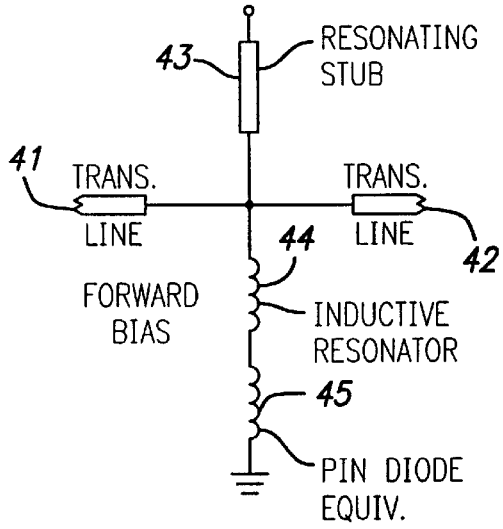
FIG. 4 is a schematic diagram of a circuit model for the SPST assembly in a forward bias condition.

The operation of the SPST switch is better understood by referring to FIGS. 3 and 4 which display the circuit equivalents to the open circuit resonant stub 22, the inductive resonator 25 and the PIN diode 24 when the PIN diode is reverse biased (or unbiased in the event of a bias failure) or forward biased, respectively. FIG. 3 shows the condition in which the PIN diode is reverse biased with approximately 80 volts in one preferred embodiment. Here the simple circuit model for the PIN diode is a capacitor 35. This capacitor is designed to series resonate with the inductive resonator 34. The resonance results in an RF shunt to ground. In a bias failure condition, the model is very similar to the reverse bias condition.

At zero bias, the PIN diode equivalent capacitance is very close to the reverse bias equivalent capacitance. Therefore, it will still resonate at the same frequency. The Q (quality factor) is lower at zero bias, resulting in less isolation from each SPST switch element.

FIG. 4 shows the model for a forward bias condition (about +1 volt). Here the PIN diode is conducting between about 50 to 100 milliamps for the preferred embodiment. Under this condition the model for the diode is a small inductor 45. This small inductor is in series with the inductive resonator 44. This series combination 44/45 is designed to parallel resonate with the resonating stub 43. The length of the resonating stub 43 is carefully controlled in order to satisfy this resonance condition for the particular RF bandwidth of the radar system. This parallel resonance results in an RF open to ground and a good RF transmission path across the switch.

Figure 5:
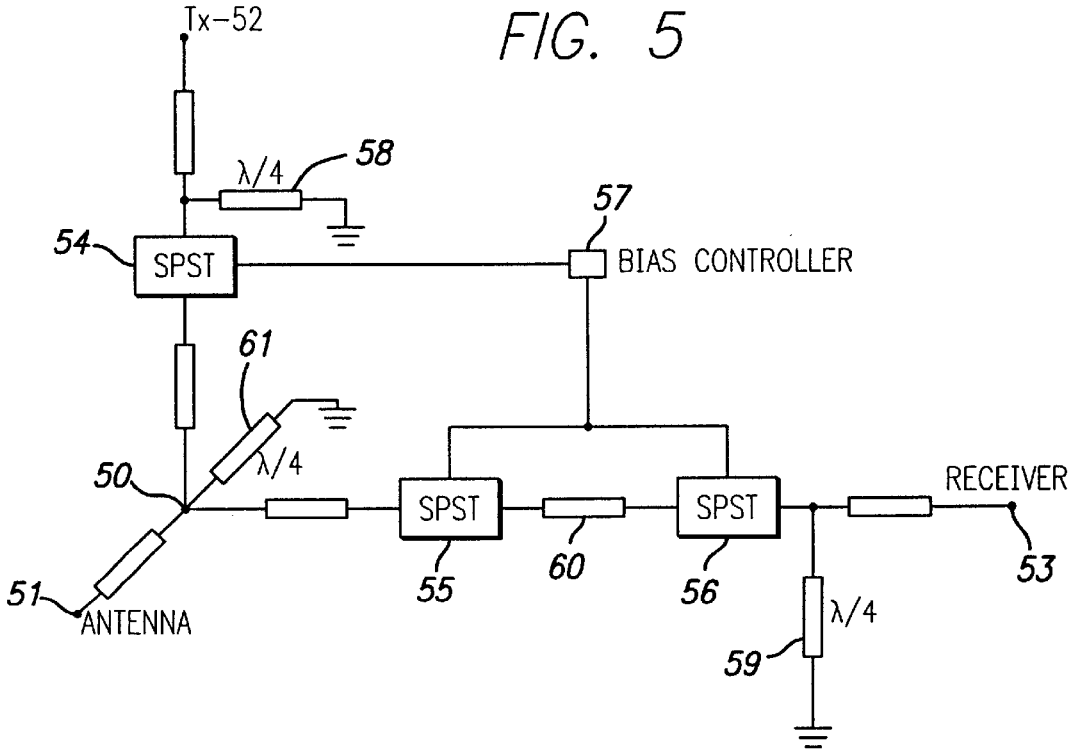
FIG. 5 is a schematic diagram of the SPDT switch of this invention as used in a radar transceiver.

The complete SPDT switch of this invention uses two or more of these SPST PIN diode switches on the receive path of the radar transceiver and one in the transmit path as shown in FIG. 5. Complementary biasing is employed for the two paths such that when the transmit path is forward biased, the receive path is reverse biased, and vice versa. The reduction in isolation of each SPST switch assembly, when and if the bias fails, is compensated for by having at least three isolated SPST switches in the transmit/receive paths instead of the normal one or two PIN switches.

In FIG. 5, the SPDT switch can be broken into two main parts, the transmit side with the single SPST assembly 54 between the transmitter 52 and the primary node 50, and the receive side with two (as shown) SPST assemblies 55, 56 between the receiver 53 and the primary node 50. The main node is connected to the antenna 51 and a quarter wavelength stub 61 that is connected to ground. The stub 61 acts to short DC to ground while blocking the RF from reaching ground. The other stubs 58 and 59 serve the same functions. The isolating effect of having a total of three (as shown) SPST assemblies between the high power transmitter 52 and the sensitive receiver 53 can be clearly seen in this view. In the event of a bias failure to one or more of the individual SPST assemblies, there will always be enough isolation to shield the low noise amplifiers (LNAs) in the receiver 53.

The bias controller 57 creates and switches the bias voltage from forward to reverse for the SPST assemblies. When the transmit side SPST assembly 54 is in a forward bias condition, the receive side SPST assemblies 55 and 56 are in a reverse bias condition, and vice versa. The connections to the SPST assemblies 55 and 56 on the receive side can be done in different ways. Shown in FIG. 5 is a parallel connection. In this specific embodiment it would be possible but not necessary to omit the blocking capacitors of the SPST assemblies on the sides of these assemblies that face the transmission line element 60. There could also be a series connection wherein the bias was supplied only to assembly 55 or 56, with the DC bias then acting through the transmission line element 60 to bias the other PIN diode 56 or 55, respectively. In this alternate embodiment, the blocking capacitors of the SPST assemblies 55 and 56 facing the transmission line element 60 should be removed in order for the DC voltage to bias both PIN diodes. In either embodiment it is advantageous to configure the transmission line element at a length just slightly different than a quarter wavelength in order to increase the bandwidth of the switch.

The preferred embodiment of this invention is fabricated using microstrip technology on an alumina substrate, and is preferably implemented using a power divider and three phase shifter bits in addition to the SPDT switch described hereinabove.

The present invention is expected to find immediate use in high power microwave circuits in which a need exists to switch the arrays in a radar antenna between transmit and receive modes, while protecting the sensitive circuits on the receiver path from damage in the event of a bias failure for the PIN diodes.

Thus, the present invention has been described herein with reference to an illustrative embodiment and an illustrative application. Those having ordinary skill in the art and access to the present teachings will recognize additional modifications, applications and embodiments within the scope thereof. For example, this SPDT switch could be used with radars transmitting at different wavelengths than the embodiment described above, requiring certain routine adjustments in the circuit elements.

It is therefore intended by the appended claims to cover any and all such applications, modifications and embodiments with the spirit and scope of the present invention.

Accordingly,

What is claimed is:

1. A switch comprising:

a first capacitor coupled to an input node at a first end and to a common node at a second end thereof;

a second capacitor coupled to said common node at a first end and an output node at a second end thereof;

a resonating stub connected between said common node and an open circuit;

an inductive resonator electrically and physically connected directly to said common node at one end and having a second end;

a PIN diode electrically and physically connected directly between said second end of said inductive resonator and ground; and means for providing bias control coupled to said common node.

2. The invention of claim 1 further including a first section of transmission line connected between said first end of said first capacitor and said input node.

3. The invention of claim 2 further including a second section of transmission line connected between said second end of said first capacitor and said common mode.

4. The invention of claim 3 further including a third section of transmission line connection between said common node and said first end of said second capacitor.

5. The invention of claim 4 further including a fourth section of transmission line connected between said second end of said second capacitor and said output node.

6. The invention of claim 1 wherein said means for providing bias control includes a bias controller.

7. The invention of claim 6 wherein said means for providing bias control includes a bias choke connected between said bias controller and said common node.

8. A switch comprising:

a first capacitor coupled to an input node at a first end and to a common node at a second end thereof;

a second capacitor coupled to said common node at a first end and an output node at a second end thereof;

a resonating stub connected between said common node and an open circuit;

an inductive resonator electrically and physically connected directly to said common node at one end and having a second end;

a PIN diode electrically and physically connected directly between said second end of said inductive resonator and ground; and means for providing variable bias control to said diode via said common node.

* * * * *